US009108760B2

(12) United States Patent
Begim

(10) Patent No.: US 9,108,760 B2
(45) Date of Patent: Aug. 18, 2015

(54) RETAIL SEALED FOLDING BOX WITH HANDLE

(71) Applicant: Moshe Begim, Torrance, CA (US)

(72) Inventor: Moshe Begim, Torrance, CA (US)

( * ) Notice: Subject to any disclaimer, the term of this patent is extended or adjusted under 35 U.S.C. 154(b) by 0 days.

(21) Appl. No.: 14/084,547

(22) Filed: Nov. 19, 2013

(65) Prior Publication Data

US 2014/0138429 A1 May 22, 2014

Related U.S. Application Data

(60) Provisional application No. 61/728,086, filed on Nov. 19, 2012.

(51) Int. Cl.

| | |
|---|---|
| ***B65D 5/468*** | (2006.01) |
| ***B65D 25/22*** | (2006.01) |
| ***B65D 25/54*** | (2006.01) |
| ***B31B 1/82*** | (2006.01) |
| ***B31B 1/86*** | (2006.01) |
| ***B65D 5/42*** | (2006.01) |
| ***B65D 5/46*** | (2006.01) |
| ***B65D 5/66*** | (2006.01) |
| ***B65D 5/22*** | (2006.01) |

(52) U.S. Cl.

CPC ..... *B65D 5/4204* (2013.01); *B65D 5/22* (2013.01); *B65D 5/4208* (2013.01); *B65D 5/46072* (2013.01); *B65D 5/6652* (2013.01)

(58) Field of Classification Search

CPC ..... B65D 5/4204; B65D 5/4208; B65D 5/46072; B65D 25/22; B31B 1/82; B31B 1/86; B31B 1/88

USPC ..... 229/117.14, 117.16, 162.1, 172, 229/117.15, 178; 206/769, 806; 493/53, 88

See application file for complete search history.

(56) References Cited

U.S. PATENT DOCUMENTS

| | | | | |
|---|---|---|---|---|
| 1,223,013 | A | | 4/1917 | Wilson |
| 1,749,771 | A | | 3/1930 | Levey |
| 2,124,335 | A | * | 7/1938 | Klein ..... 229/178 |
| 2,323,746 | A | | 7/1943 | Woolf |
| 2,351,207 | A | * | 6/1944 | Henderson et al. ..... 229/117.15 |
| 2,949,151 | A | | 8/1960 | Goldstein |
| 2,993,590 | A | | 7/1961 | Denton |
| 3,185,295 | A | | 5/1965 | Crane |
| 3,311,285 | A | * | 3/1967 | Korr ..... 229/145 |
| 3,486,615 | A | | 12/1969 | Woskin |
| 3,523,403 | A | | 8/1970 | Collins |

(Continued)

FOREIGN PATENT DOCUMENTS

GB 1142773 8/1967

*Primary Examiner* — Gary Elkins

(74) *Attorney, Agent, or Firm* — Robert Lauson; Lauson & Tarver

(57) ABSTRACT

A hanging display box with a carrying handle is made from a folding cardboard sheet. The cardboard sheet includes a display panel with a window, a substantially transparent plastic material covering the window and having flaps extending substantially beyond the display panel. A top wall attached to the display panel is connected to a hanger panel with an opening, and a bottom wall attached to the display panel is connected to a rear panel also having an opening, so that when the rear panel is folded adjacent the hanger panel, the openings align to form the carrying handle. Side walls attached to the display panel releasably fix the plastic material against the window such that, when the box is opened, the plastic material and cardboard are easily separated and recycled.

9 Claims, 10 Drawing Sheets

(56) References Cited

U.S. PATENT DOCUMENTS

| | | | | |
|---|---|---|---|---|
| 3,540,354 | A | 11/1970 | Tachibana | |
| 3,624,236 | A | 11/1971 | Frappier | |
| 3,670,881 | A * | 6/1972 | Dutcher | 229/125.015 |
| 3,864,200 | A | 2/1975 | Marshall | |
| 3,635,451 | A | 1/1976 | Wagner | |
| 3,946,936 | A * | 3/1976 | Brown | 229/117.18 |
| 3,972,270 | A | 8/1976 | Marshall | |
| 4,030,662 | A | 6/1977 | Gess | |
| 4,235,336 | A | 11/1980 | Dudas | |
| 4,261,462 | A | 4/1981 | Wyxocki | |
| 4,279,376 | A * | 7/1981 | Roccaforte | 229/223 |
| 4,355,758 | A * | 10/1982 | Lavery | 229/117.18 |
| 4,485,920 | A | 12/1984 | Skylvik | |
| 4,518,086 | A | 5/1985 | Roccaforte | |
| 4,842,141 | A | 6/1989 | Segal | |
| 4,949,845 | A | 8/1990 | Dixon | |
| 5,060,853 | A * | 10/1991 | Gulliver et al. | 229/162.1 |
| 5,620,134 | A | 4/1997 | Gulliver | |
| 5,704,481 | A | 1/1998 | Lutz | |
| 6,050,415 | A | 4/2000 | Lind | |
| 6,276,529 | B1 | 8/2001 | Feehan, Jr. | |
| 6,279,820 | B1 * | 8/2001 | Collinet | 229/117.14 |
| 6,308,832 | B1 | 10/2001 | Pirro | |
| 6,523,689 | B2 | 2/2003 | Mickel | |
| 6,571,953 | B2 | 6/2003 | Sherline | |
| 6,676,584 | B2 | 1/2004 | Tachikawa | |
| 6,739,453 | B1 | 5/2004 | Mazurek | |
| 6,808,106 | B1 | 10/2004 | Grigsby | |
| 6,840,437 | B2 | 1/2005 | Chen | |
| 7,051,876 | B2 | 5/2006 | Grosskopf | |
| D556,565 | S | 12/2007 | Nazari | |
| 7,399,267 | B2 | 7/2008 | Moen | |
| 7,571,810 | B2 | 8/2009 | Tilton | |
| 7,681,733 | B2 | 3/2010 | Grosskopf | |
| 7,726,480 | B2 | 6/2010 | Nazari | |
| 7,726,481 | B2 | 6/2010 | Grosskopf | |
| D621,695 | S | 8/2010 | Van Solkema | |
| 7,882,950 | B2 | 2/2011 | Nazari | |
| 8,066,177 | B2 | 11/2011 | Tanaka | |
| 8,091,704 | B2 | 1/2012 | Trigg | |
| 8,205,746 | B2 | 6/2012 | Nazari | |
| 8,205,747 | B2 | 6/2012 | Nazari | |
| 2001/0015374 | A1 | 8/2001 | Schultz | |
| 2001/0022318 | A1 | 9/2001 | Kaden | |
| 2007/0125678 | A1 | 6/2007 | Green | |
| 2007/0187273 | A1 | 8/2007 | Grosskopf | |
| 2008/0029417 | A1 | 2/2008 | Begim | |
| 2008/0142393 | A1 | 6/2008 | Grosskopf | |
| 2010/0133331 | A1 * | 6/2010 | Sorrentino et al. | 229/162.1 |
| 2010/0213099 | A1 * | 8/2010 | Meneses | 206/701 |
| 2011/0198393 | A1 | 8/2011 | Bates | |
| 2012/0080511 | A1 | 4/2012 | Sorrentino | |

* cited by examiner

RETAIL SEALED FOLDING BOX WITH HANDLE

This application claims priority to provisional application No. 61/728,086, filed Nov. 19, 2012.

BACKGROUND

Folding boxes for use in retail sales, including hanging packaging created from a single sheet of folded cardboard, is known in the art. Typically such boxes comprises a cardboard sheet stamped out of a cardboard blank, which is then folded into a three-dimensional box-like shape, which may or may not have a folding lid for opening and closing. These boxes often have openings incorporated into the cardboard sheet for display or hanging purposes.

Examples of folding single sheet cardboard retail packaging are Sorrentino (U.S. Pat. App. 2012/0080511), Tanaka (U.S. Pat. No. 8,066,177) and Chen (U.S. Pat. No. 6,840,437). Sorrentino teaches a package folded from a single cardboard sheet, having a window disposed across two sides of the folded package. Tanaka teaches a package folded from a single cardboard sheet without a window, but having anchoring tabs adapted to connect the lid to the side of the box. Chen teaches a windowless package formed from a single cardboard sheet, with dividers incorporated into the completed package.

These types of packages have various drawbacks. For example, they may expose different sides of the cardboard sheet upon folding, and require printing both sides of the cardboard, thereby raising production costs. They are frequently not recyclable. And when folded, they do not provide a handle by which they may be easily carried.

Although the cardboard component of folding packages may be recyclable, packages having plastic windows are generally not since that portion is not recyclable. While biodegradable bioplastics are available, these plastics generally have a low melting temperature, and a tendency for the melting temperature to decrease further if heated repeatedly. Therefore, although a bioplastic may have an initial melting temperature of 150° or 160° Fahrenheit, if heated for vacuum forming, the resulting molded bioplastic may have a melting temperature of 130° F. or even 120° F. Since warehouse or transportation conditions may exceed 120° F., vacuum formed bioplastics are disfavored for packaging.

There is thus a need for a box used in retail packaging, formed of a single sheet of folded cardboard, that when folded, exposes only one side of the cardboard sheet thereby requiring only one sided printing, and which has a window with a high melting temperature, but which is biodegradable. And a built-in handle for carrying the box is advantageous.

SUMMARY

A hanging display box having a built-in carrying handle is made from a foldable cardboard sheet. The cardboard sheet is preferably a unitary blank, printed on only one side. The cardboard sheet has a display panel with a window, and a substantially transparent plastic material overlaying the window. While conventional materials, such as cellophane and similar plastics are contemplated for the transparent plastic material, the use of biodegradable bioplastics, for example PLA is specifically contemplated.

The transparent material preferably includes flaps extending substantially beyond the display panel. A top wall is attached to the display panel in a folding arrangement, and a hanger panel is attached to the top wall, also in a folding arrangement. The hanger panel has a first opening which will form part of the carrying handle. The openings in the hanger panel and the rear panel are preferably sized for grasping and for hanging the box on a peg. As such, the openings may be large and oblong to facilitate a user inserting fingers and carrying the box.

A bottom wall is also attached to the display panel in a folding arrangement, preferably on the opposite side of the display panel as the top wall, and a rear panel is attached to the bottom wall in a folding arrangement. The rear panel has a second opening which will also forms part of the carrying handle. Side walls are also attached to the display panel in a folding arrangement, and when folded into a side wall assembly, they releasably fix the plastic material to the display panel, covering the window.

When the rear panel is folded adjacent to the hanger panel to close the box, the first opening aligns with the second opening, together forming the carrying handle. In one embodiment, the rear panel includes opposing third flaps for engaging the fixed side wall assembly and enclosing the box.

Preferably, the side wall assemblies include first side flaps attached to the top wall and opposing second side flaps attached to the bottom wall. The side walls each include an outer panel and an inner panel attached to the outer panel in a folding arrangement. An anchor panel is attached to the inner panel, opposite from the outer panel and also in a folding arrangement, for anchoring the outer panel and inner panel over the first opposing side flaps and the second opposing side flaps, thereby forming a side wall assembly which is rigid.

In order to construct the hanging display box and enclosing an item, a single cardboard material is provided, preferably printed only on one side. The cardboard material is stamped into a foldable sheet having a display panel, and a portion of the display panel is removed to form a window. A substantially transparent material is placed over the window, extending substantially beyond the display panel. Preferably the portion extending substantially beyond the display panel are flaps of transparent material.

The blank is folded to encapsulate the transparent material and form a shell. Specifically, a user may first form the shell by folding the top wall relative to the display panel, and folding the bottom wall in the same direction relative to the display panel. Flaps attached to the top wall and bottom wall are then brought into alignment and the side walls folded over them.

Once the shell is formed, an item is placed in the shell, and a rear panel is folded over the item to form the display box. When the rear panel is folded over, holes in the blank may be aligned to form a carrying handle. For securing the box in a closed configuration, the rear panel may be adhered to the shell to seal the display box. Once purchased, a user may open the box and remove the item, and as part of that process partially unfolding the blank and separating the substantially transparent material from the cardboard material. In this manner, the plastic and cardboard components of the box can be disposed of separately are thus easily recyclable.

REFERENCE NUMBERS

Figure 1:
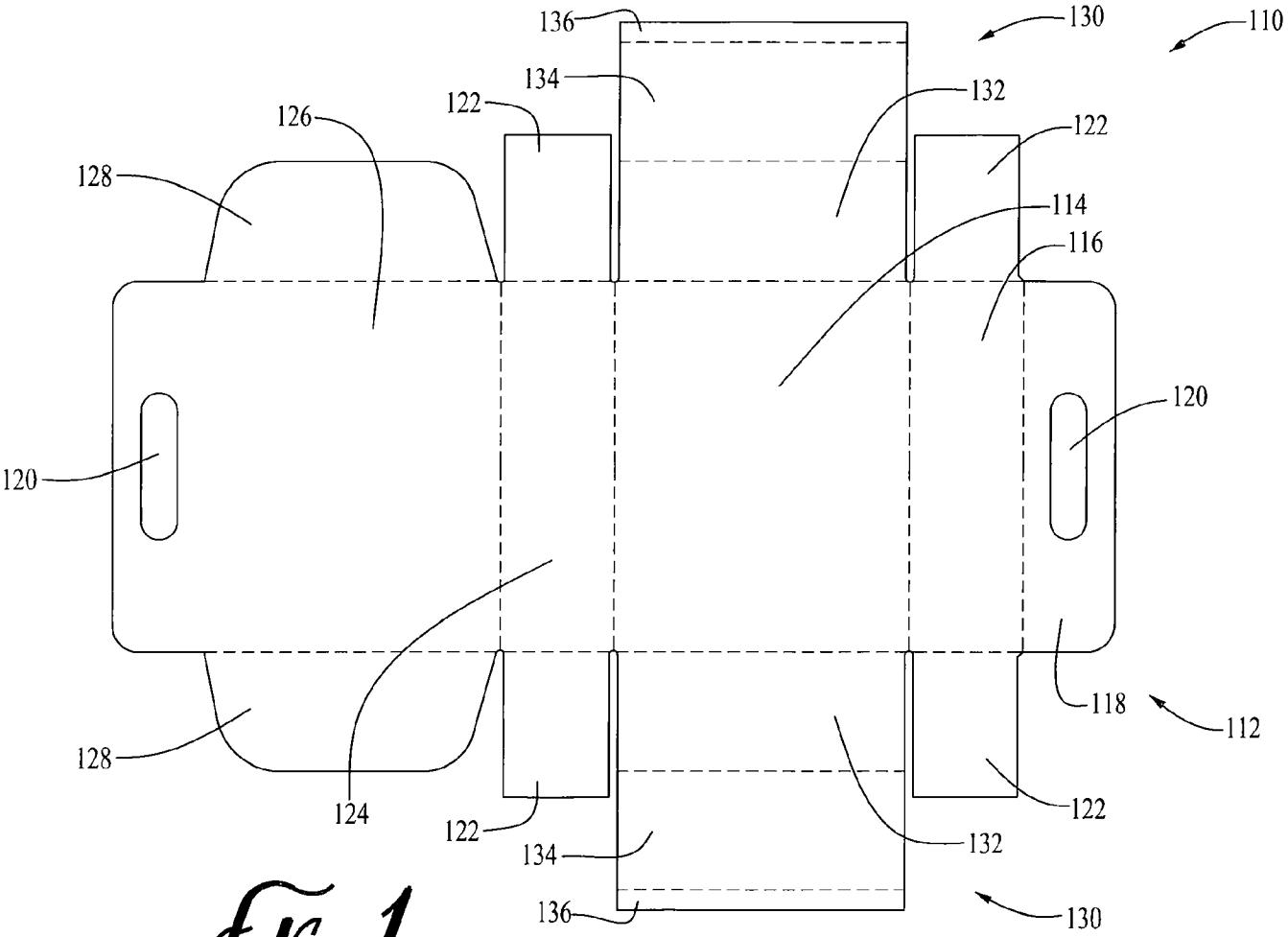
FIG. 1 is a plan view of a first embodiment cardboard sheet adapted to be folded into a first embodiment folding box.

110. folding box
112. cardboard sheet
114. display panel
116. top side wall
118. hanger panel
120. opening
122. side flap
124. bottom side wall
126. rear panel
128. rounded side flap
130. side wall panel
132. outer panel
134. inner panel
136. anchoring panel
138. printed side
210. second embodiment folding box
212. cardboard sheet
214. display panel
216. top side wall
218. hanger panel
220. opening
222. side flap
224. bottom side wall
226. rear panel
228. rounded side flap
230. side wall panel
232. outer panel
234. inner panel
236. anchoring panel
238. window
310. transparent sheet
312. pane region
314. flap members
316. crease lines

DESCRIPTION

Referring to FIG. 1, a first embodiment folding box 110 includes a cardboard sheet 112 shown in an unfolded configuration. The cardboard sheet 112 has a display panel 114 which will serve as the front of the completed box 110. A top side wall 116 is foldably attached to the display panel 114, which will form the top of the box 110. A hanger panel 118 having an opening 120 for grasping, or hanging and displaying the box 110 is foldably attached to the top side wall 116 opposite the display panel 114. Two side flaps 122 are foldably attached to the remaining sides of the top side wall 116.

Still referring to FIG. 1, a bottom side wall 124 is foldably attached to the display panel 114. A rear panel 126 is foldably attached to the bottom side wall 124 opposite the display panel 114. The rear panel 126 also includes an opening 120 for grasping, or hanging and displaying the box 110. The openings 120 will align in the box 110, forming a handle or hanging structure. In this manner, the box 110 can hang on a peg wall, or sit in a display or shelf, and when a user selects the box 110, the hanging structure is useful as a handle for holding the box 110. That is, the user may insert one or more fingers or his or her hand into the opening 120 and grasp the box 110 in this way for carrying it outside the store. The rear panel 126 includes two rounded side flaps 128 for anchoring the rear panel 126 in the box 110 foldably attached to the remaining sides of the rear panel 126. Two side flaps 122 are also foldably attached to the remaining sides of the bottom side wall 124.

Still referring to FIG. 1, two side wall panels 130, are attached to the remaining sides of the display panel 114. The side wall panels 130 each include an outer panel 132 foldably attached to the display panel 114, an inner panel 134 foldably attached to the outer panel 132, and anchoring panel 136 for holding the side wall panels 130 in position when folded, foldably attached to the inner panel 134.

Figure 2:
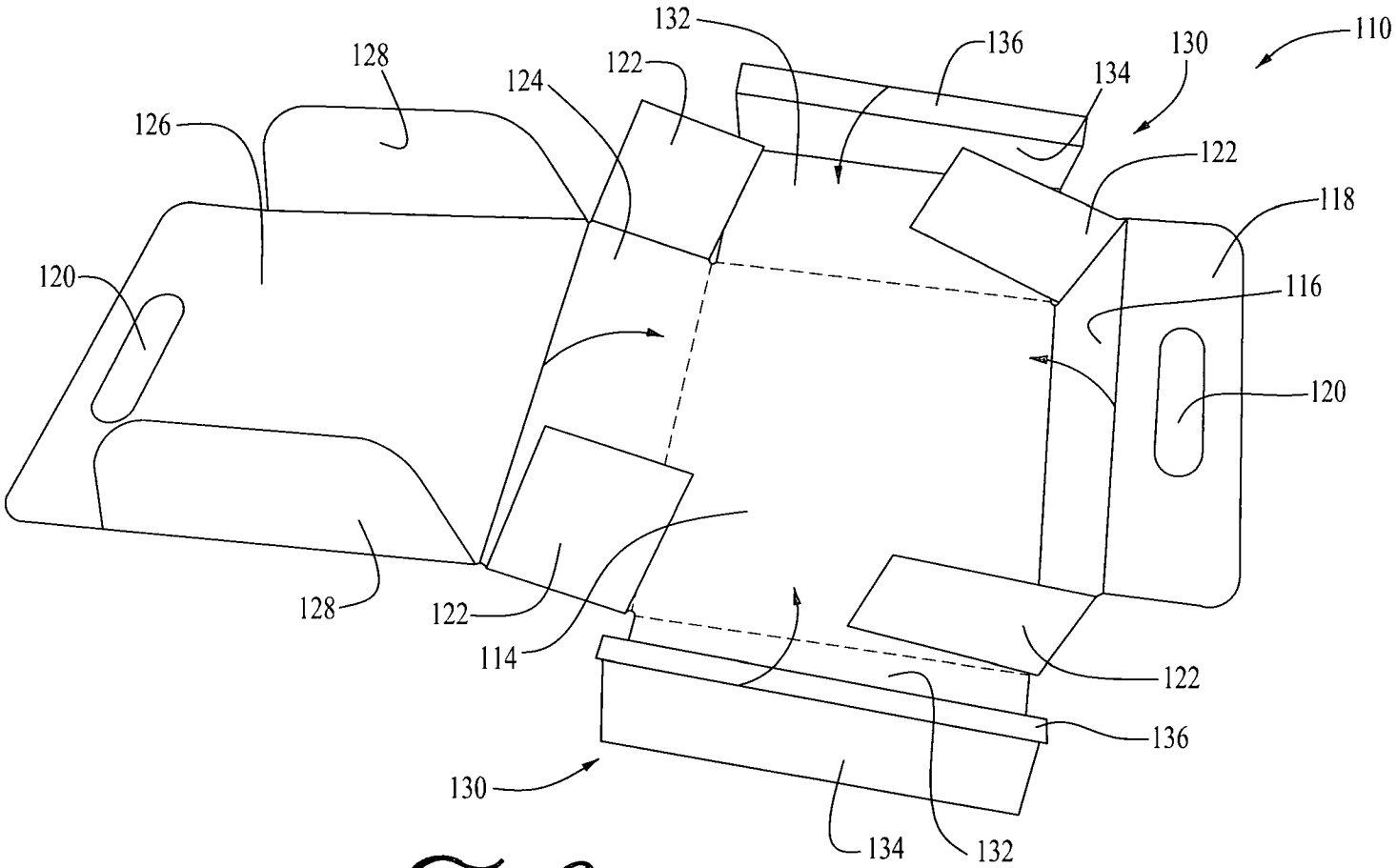
FIG. 2 is a perspective view of the first embodiment cardboard sheet partially folded into the first embodiment folding box.
Figure 3:
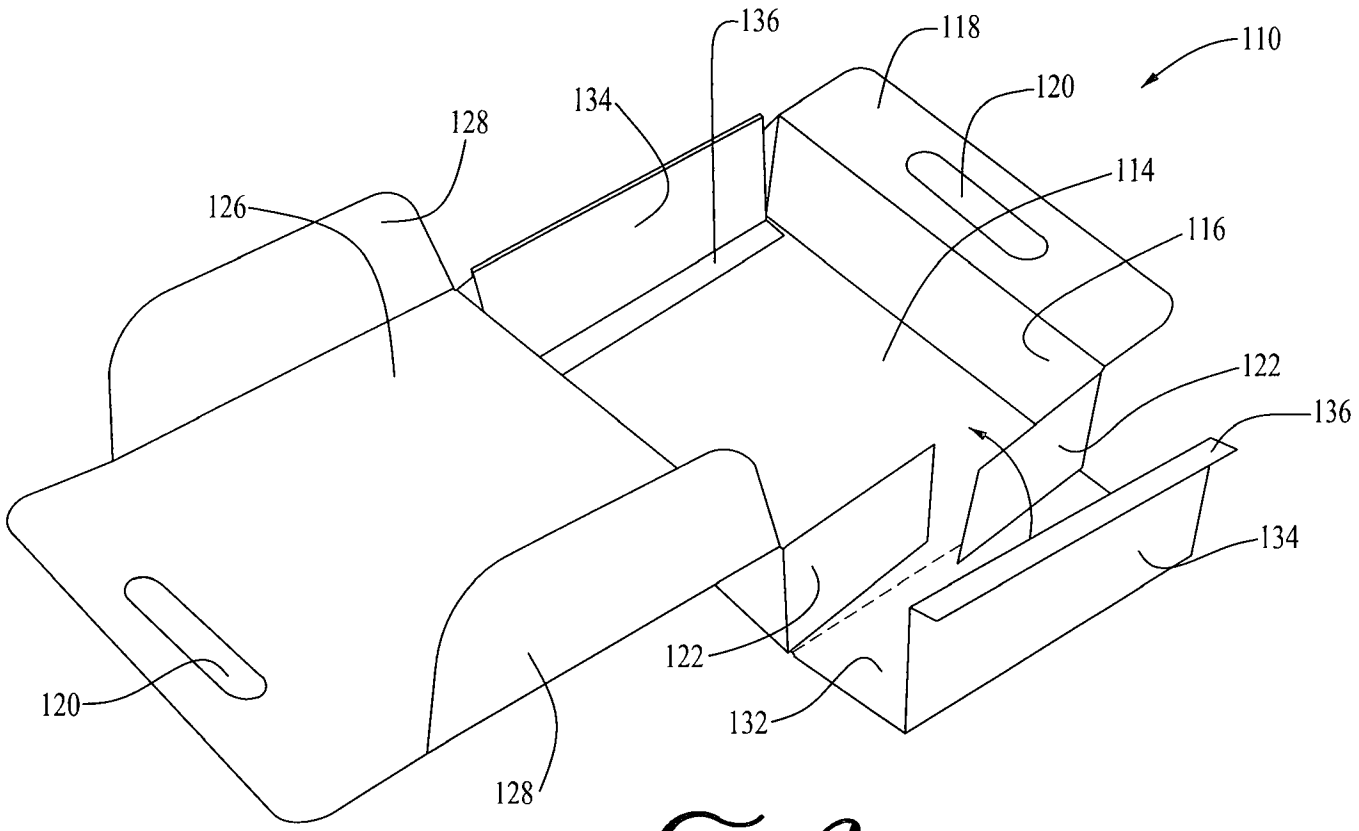
FIG. 3 is a perspective view of a partially assembled first embodiment folding box.

Referring to FIGS. 2 and 3, the first embodiment box 110 is shown in the initial stages of assembly. In order to assemble the first embodiment box 110, the top side wall 116, the bottom side wall 124, and the side wall panels 130 are folded away from the indicia-bearing printed side (ref. no. 138 in FIG. 6) of the display panel 114, to create an enclosing space. The side flaps 122 of the top side wall 116 and bottom side wall 124 are brought into alignment with the junction of the display panel 114 and outer panels 132, which may be creased, thereby allowing the inner panels 134 to fold over the side flaps 122. Once the inner panels 134 fold over the side flaps 122, anchoring the side flaps 122 in position, the anchoring panels 136 fold against the display panel 114, ensuring that the outer panels 132 and inner panels 134 remain in position. In one preferred embodiment, an adhesive may be used to hold the anchoring panels 136 in position.

Figure 4:
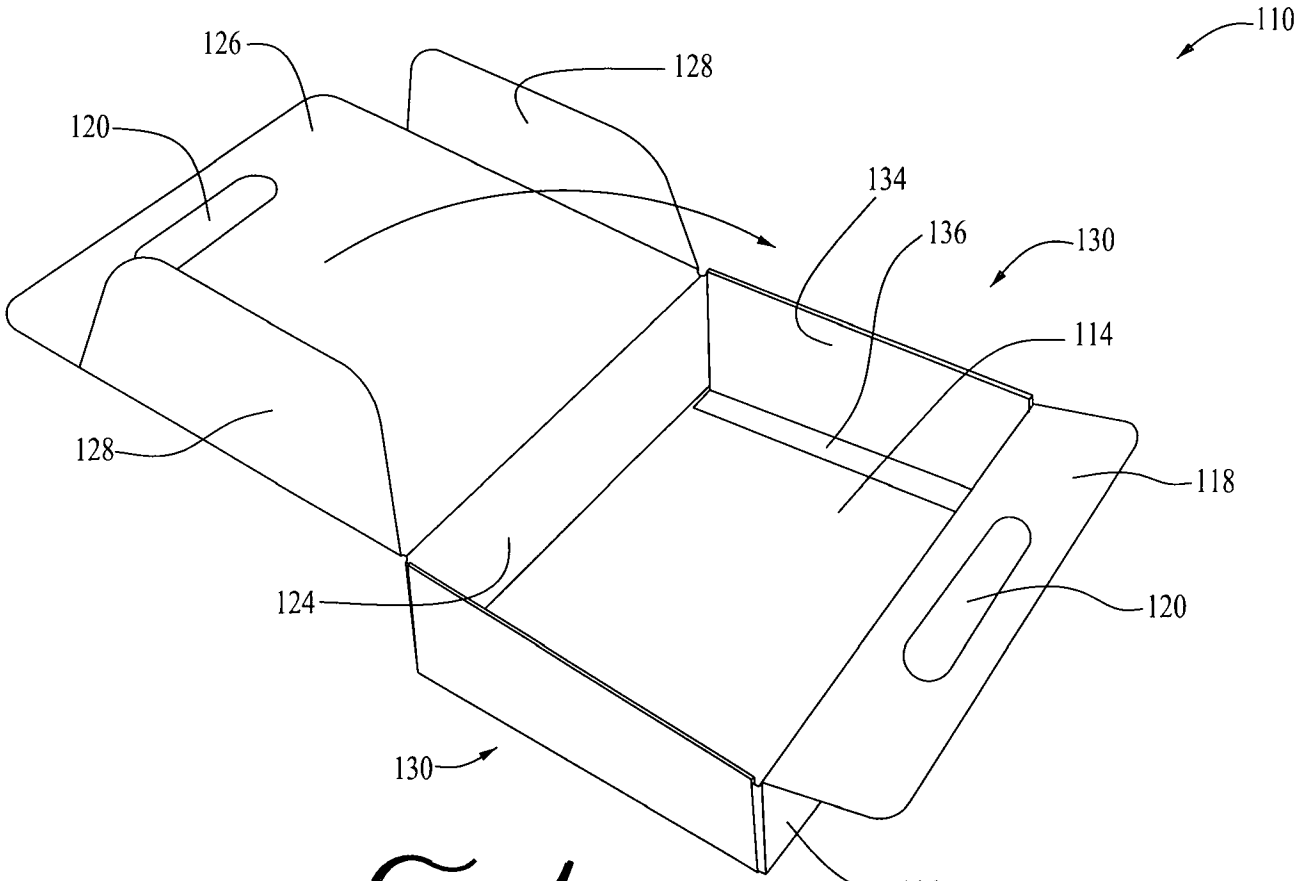
FIG. 4 is a perspective view of an assembled first embodiment folding box in an open configuration.

Referring to FIG. 4, an assembled first embodiment box 110 in an open configuration is shown. In order to close the box 110, prior to sealing, an object to be held (not shown) is placed in the space bounded by the display panel 114, top side wall 116, bottom side wall 124, and side wall panels 130. Thereafter the rounded side flaps 128 of the rear panel 126 are folded to fit inside the box 110 and the rear panel 126 folded over the in the manner shown. Once the rear panel 126 is in place, the openings 120 will align forming a handle for hanging or holding the box 110. The hanger panel 118 may adhere to an upper portion of the rear panel 126 in order to seal the box 110 prior to delivery or sale. Once the hanger panel 118 is adhered to the rear panel 126, the openings 120 form a useful handle for carrying the box 110 or hanging it on display.

Figure 5:
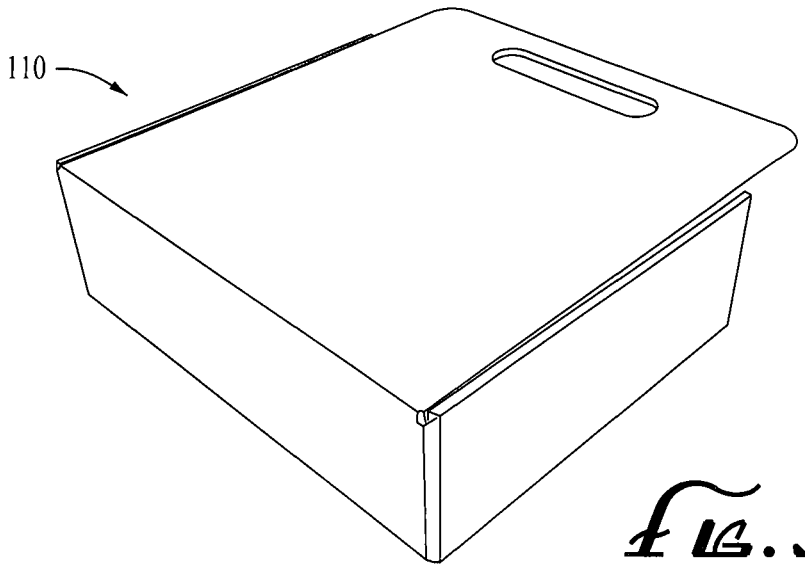
FIG. 5 is a rear perspective view of the first embodiment folding box.
Figure 6:
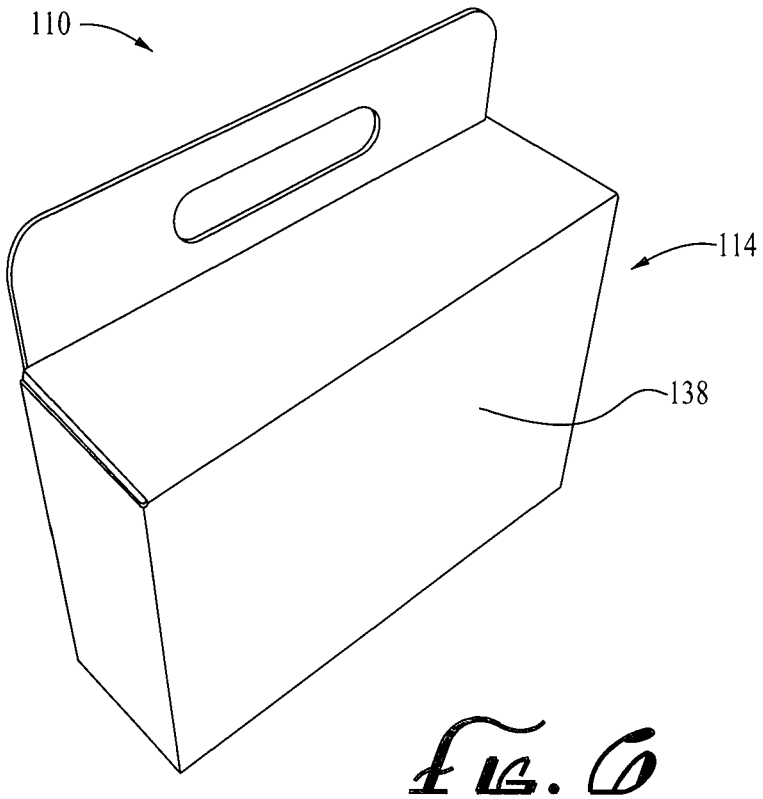
FIG. 6 is a front perspective view of the first embodiment folding box.

Referring to FIGS. 5 and 6, rear and front, respectively, perspective views of the assembled first embodiment box 110 are shown. When assembled, the blank side (not shown) of the cardboard sheet 112 is on the inside of the box 110. In this manner, a cardboard sheet 112 may be printed on one side only, saving both production time and production costs. Referring to FIG. 6, a representation of an item (not shown)

contained in the box 110 or other information may be placed on the printed side 138 of the display panel 114.

Figure 7B:
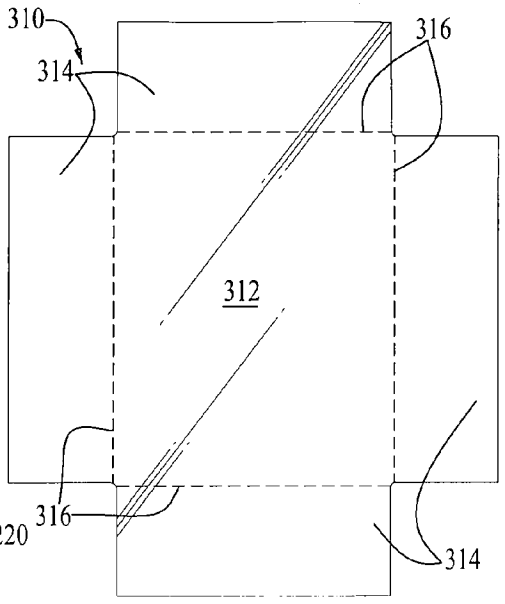
FIG. 7B is a plan view of a transparent sheet adapted to be incorporated into the second embodiment folding box having a window.
Figure 7A:
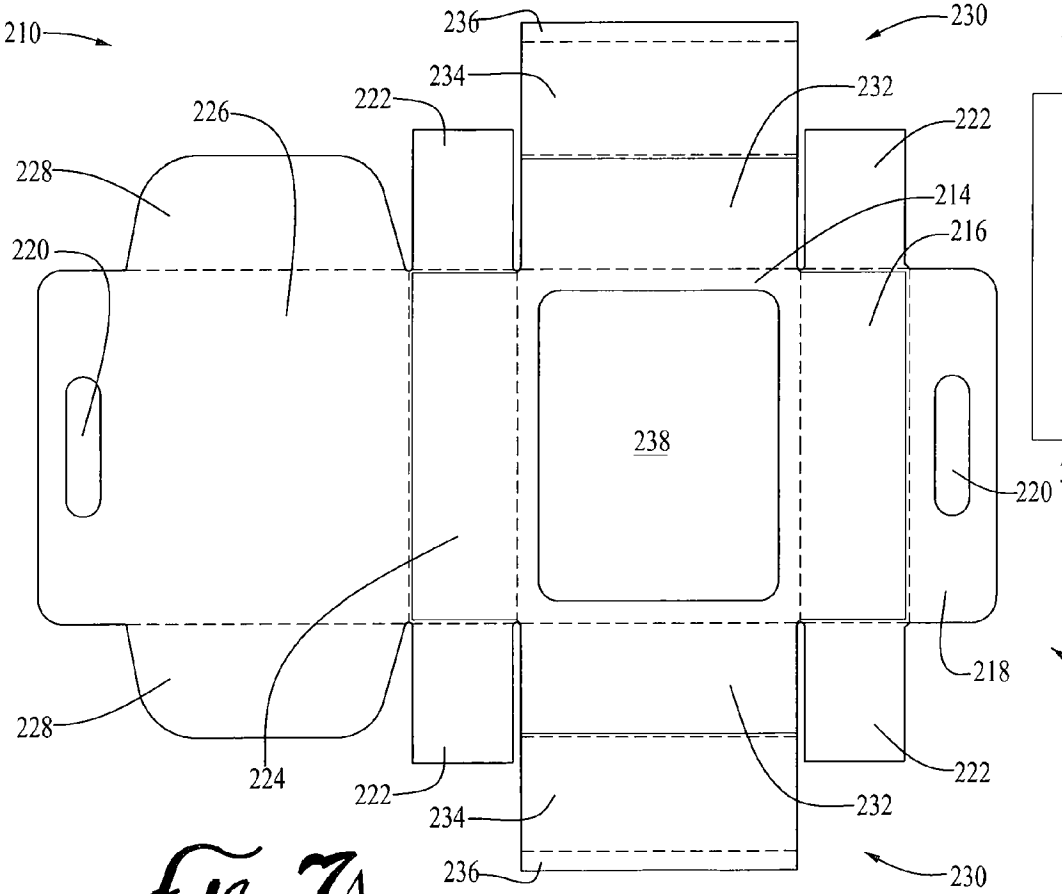
FIG. 7A is a plan view of a second embodiment cardboard sheet adapted to be folded into a second embodiment folding box having a window.

Referring to FIG. 7A, a second embodiment folding box 210 includes a cardboard sheet 212 in an unfolded configuration. The cardboard sheet 212 has a display panel 214 which will serve as the front of the completed box 210. A top side wall 216 is foldably attached to the display panel 214, which will form the top of the box 210. A hanger panel 218 having an opening 220 for grasping, or hanging and displaying the box 210 is foldably attached to the top side wall 216 opposite the display panel 214. Two side flaps 222 are foldably attached to the remaining sides of the top side wall 216.

Still referring to FIG. 7A, a bottom side wall 224 is foldably attached to the display panel 214. A rear panel 226 is foldably attached to the bottom side wall 224 opposite the display panel 214. The rear panel 226 also includes an opening 220 for grasping, or hanging and displaying the box 210. The openings 220 will align in the box 210, forming a handle or hanging structure. In this manner, the box 210 can hang on a peg wall, or sit in a display or shelf, and when a user selects a box, the hanging structure is useful as a handle for holding the box 210. The rear panel 226 includes two rounded side flaps 228 for anchoring the rear panel 226 in the box 210 foldably attached to the remaining sides of the rear panel 226. Two side flaps 222 are also foldably attached to the remaining sides of the bottom side wall 224.

Still referring to FIG. 7A, two side wall panels 230, are attached to the remaining sides of the display panel 214. The side wall panels 230 each include an outer panel 232 foldably attached to the back panel 214, an inner panel 234 foldably attached to the outer panel 232, and anchoring panel 236 for holding the side wall panels 230 in position when folded, foldably attached to the inner panel 234. Therefore, the second embodiment box 210 is identical in structure and folding pattern to the first embodiment box 110, except that the second embodiment box 210 includes a window 238 on the display panel 214 through which an item (not shown) held by the box 210 can be seen.

Referring to FIG. 7B, a transparent sheet 310 is used to cover the window 238. The transparent sheet 310 comprises a pane region 312, and flap members 314 foldably attached to the pane region 312 along crease lines 316. The flap members 314 preferably extend all the way across the outer panels 232, top side wall 222, and bottom side wall 224. Ideally, the transparent sheet 310 comprises a polymer such as Polylactic Acid (PLA), or a similar transparent bioplastic. Since the transparent sheet 310 is releasable and easily separated from the box 210, sorting them with similar materials for recycling is facilitated.

Currently, PLA and other bioplastics have low glass transmission temperatures (i.e., the temperature at which they change from a hard and relatively brittle state into a molten rubber-like state), and those glass transmission temperatures become even lower upon heating and re-heating. For this reason, heating and vacuum-forming PLA often results in a plastic unsuitable for use in hot environments such as warehouses, where temperatures routinely exceed 120° Fahrenheit.

Since PLA's initial glass transmission temperature is often in excess of 140°-150° Fahrenheit, an un-molded sheet of PLA resists melting and is better suited to high temperature environments. For this reason, the transparent sheet 310 is not vacuum formed for insertion into the cardboard sheet 210, but rather is cut to shape, and crease lines 316 physically formed on the sheet and the flap members 314 folded without applying any heat during assembly. Although PLA is one contemplated material, other embodiments may include any type of plastic window, including Polyethylene terephthalate (PET), or other commonly used plastics.

Figure 8:
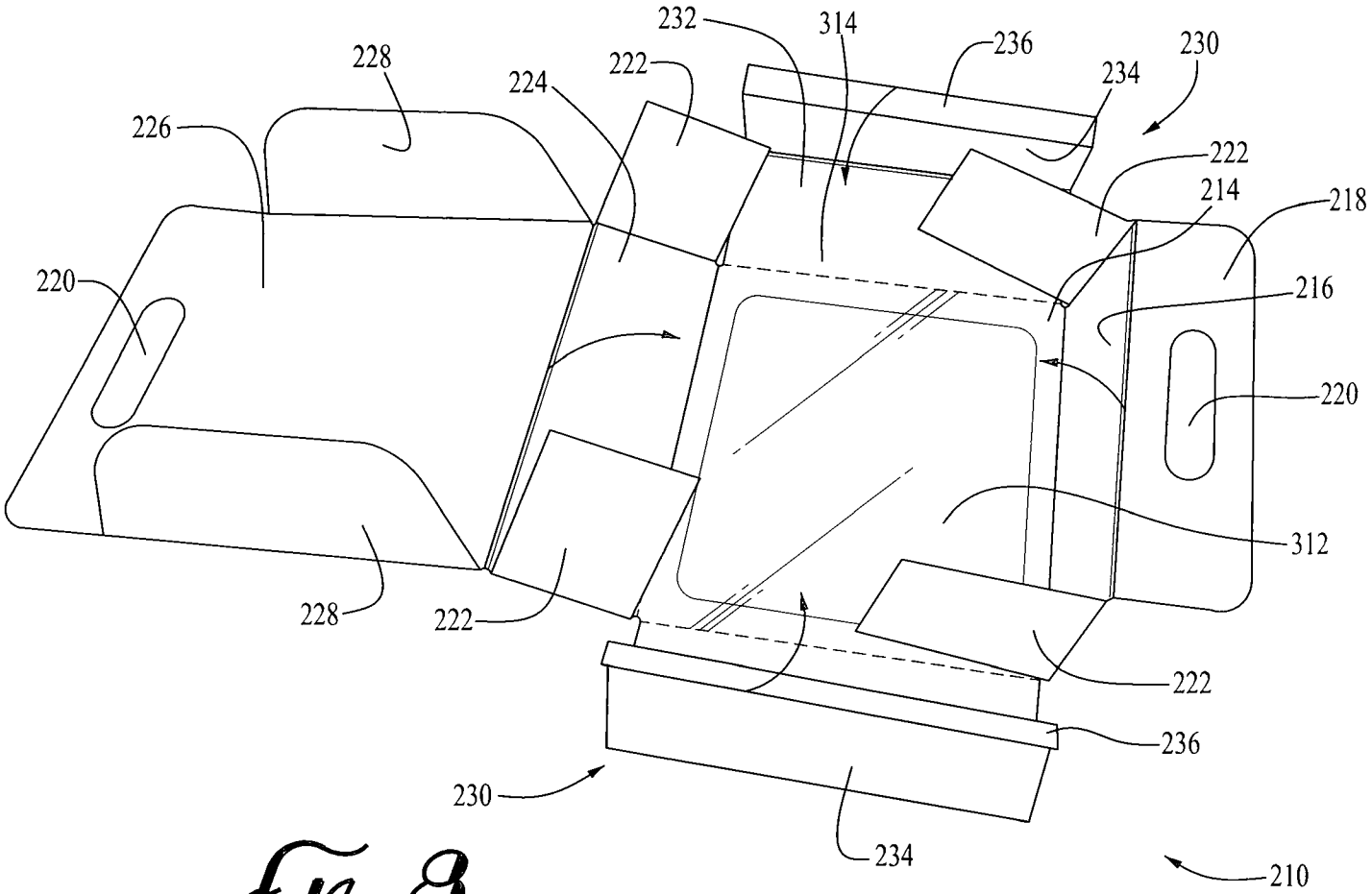
FIG. 8 is a perspective view of the second embodiment cardboard sheet partially folded into the second embodiment folding box.
Figure 9:
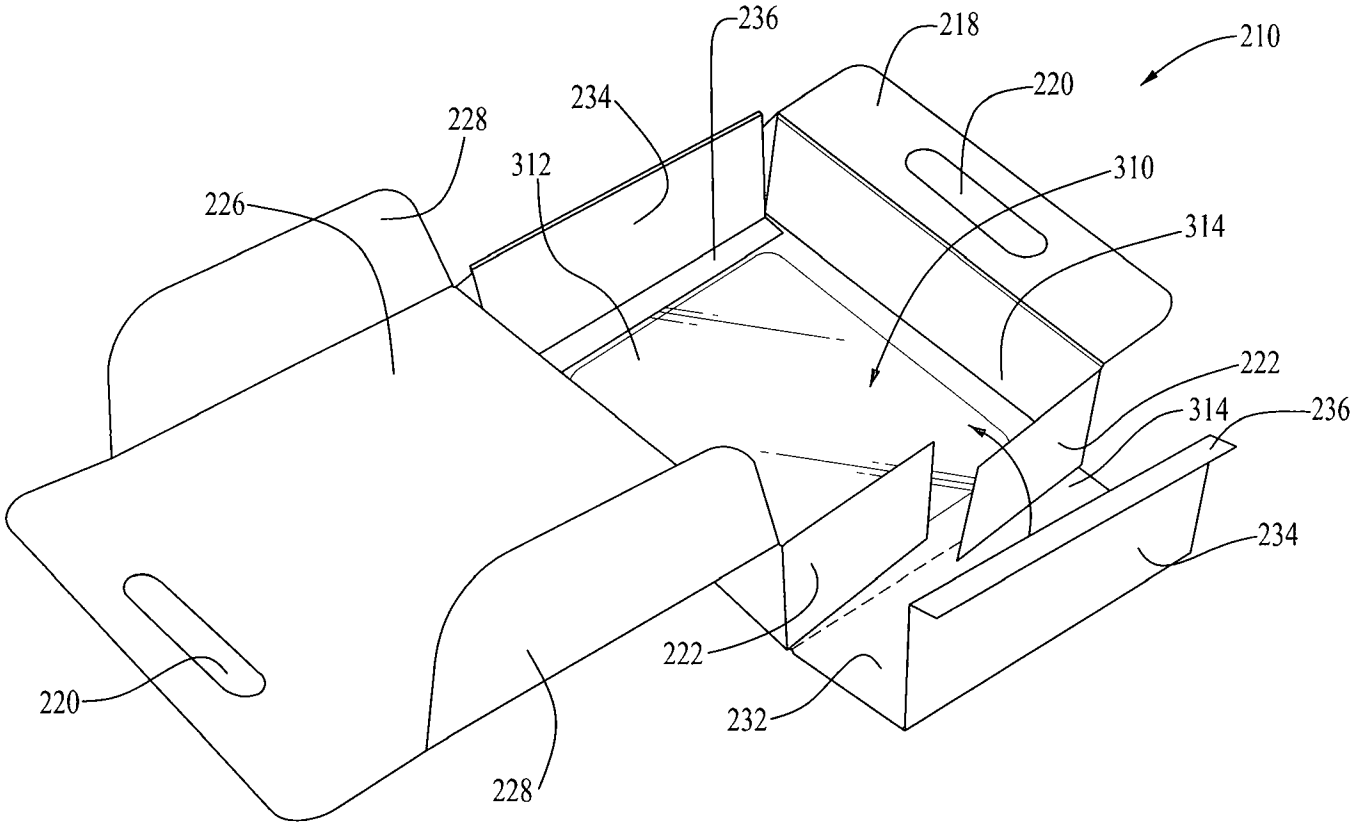
FIG. 9 is a perspective view of a partially assembled second embodiment folding box.

Referring to FIGS. 8 and 9, the second embodiment box 210 and transparent sheet 310 are shown in the initial stages of assembly. Referring to FIG. 8, in order to assemble the second embodiment box 210, the transparent sheet 310 is seated over the display panel 214. Preferably, the pane region 312 of the transparent sheet 310 is the same size as the display panel 214. Thereafter, the top side wall 216, the bottom side wall 224, and the side wall panels 230 are folded to form an enclosure in the manner shown. With the pane region 312 the same size as the display panel 214, the flap members 314 will lay against the top and bottom side walls 216/224 and side wall panels 230.

Referring to FIG. 9, the side flaps 222 of the top side wall 216 and bottom side wall 224 are brought into alignment with the crease formed at the junction of the display panel 214 and outer panels 232, thereby allowing the inner panels 234 to fold over the side flaps 222. In this manner, the outer panels 232 and side flaps 222 sandwich the flap members 314 holding the transparent sheet 310 in place. In an alternative embodiment, the flap members 314 may be sandwiched between the side flaps 222 and inner panels 234, depending on the desired method of construction. Once the inner panels 234 fold over the side flaps 222, anchoring the side flaps 222 and transparent sheet 310 in position, the anchoring panels 236 fold against the pane portion 312 of the transparent sheet 310, ensuring that the outer panels 232 and inner panels 234 remain in position. In one preferred embodiment, an adhesive may be used to hold the anchoring panels 236 in position.

Figure 10:
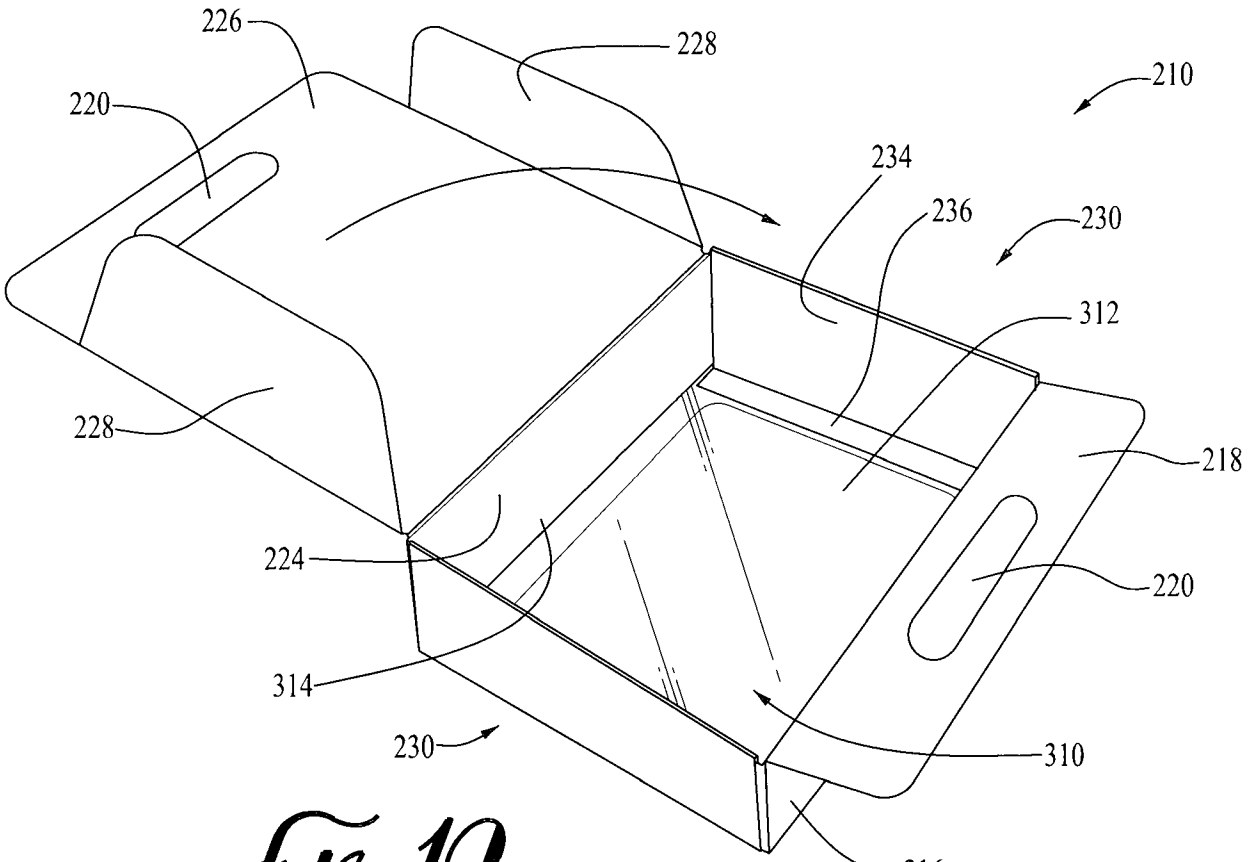
FIG. 10 is a perspective view of an assembled second embodiment folding box in an open configuration.

Referring to FIG. 10, an assembled first embodiment box 210 in an open configuration is shown. In order to close the box 210, prior to sealing, an object to be held (not shown) is placed in the space bounded by the display panel 214, top side wall 216, bottom side wall 224, and side wall panels 230. Thereafter the anchoring panels 228 of the rear panel 226 are folded to fit inside the box 238 and the rear panel 226 folded over the in the manner shown. Once rear panel 226 is in place, the openings 220 will align forming a handle for hanging or holding the box 210. The hanger panel 218 may adhere to an upper portion of the rear panel 226 in order to seal the box 210 prior to delivery or sale. Once the hanger panel 218 is adhered to the rear panel 226, the openings 220 form a useful handle for carrying the box 210 or hanging it on display.

Figure 11:
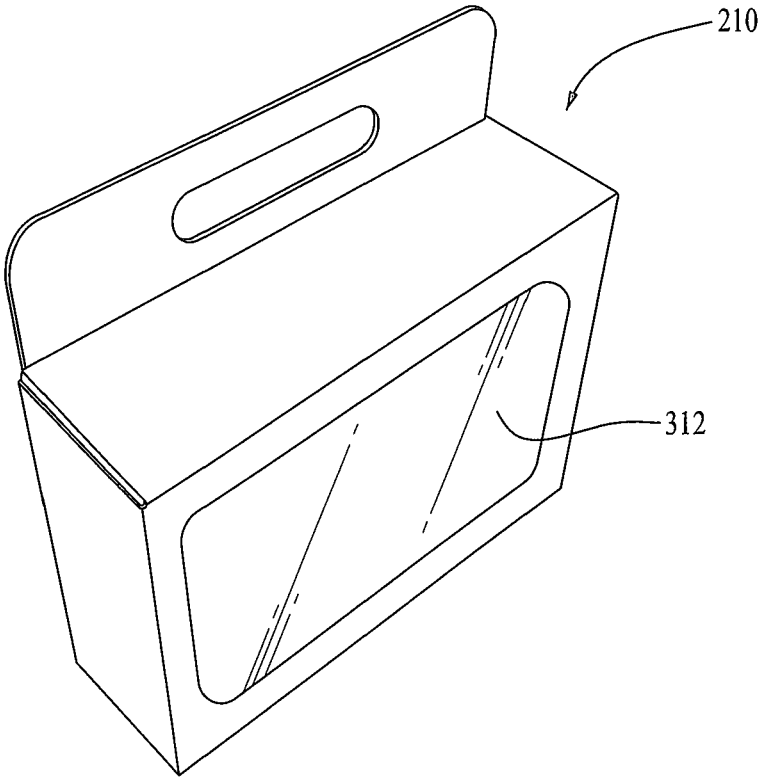
FIG. 11 is a front perspective view of the second embodiment folding box.

Referring to FIG. 11, a front perspective view of an assembled second embodiment box 210 is shown. When assembled, the pane region 312 of the transparent sheet 310 is shown, through which an item (not shown) contained in the box 210 or other display may be placed and viewable in the closed box 210. Because the transparent sheet 310 has not been heated during assembly, the box 210 can withstand higher temperatures when stored, and while remaining 100% recyclable.

The foregoing description is sufficient in detail to enable one skilled in the art to make and use the invention. It is understood, however, that the detail of the preferred embodiments presented is not intended to limit the scope of the invention. For instance, recyclable bioplastics other than PLA may be used, and the shape of the box may be other than square or rectangular. Therefore equivalents thereof and other modifications which come within the scope of the invention as defined by the claims will become apparent to those skilled in the art upon reading this specification.

What is claimed is:

1. A hanging display box with a carrying handle, comprising;

a foldable cardboard sheet having a display panel with a window;

a substantially transparent plastic material overlaying the window and having flaps extending substantially beyond the display panel;

a top wall foldably attached to the display panel;

a hanger panel foldably attached to the top wall, the hanger panel having a first opening;

a bottom wall foldably attached to the display panel;

a rear panel foldably attached to the bottom wall, the rear panel having a second opening;

side walls foldably attached to the display panel, when folded releasably fixing the plastic material to the display panel; and wherein the rear panel is foldable adjacent the hanger panel, such that the first opening aligns with the second opening to form the carrying handle.

2. The sheet of claim .1 wherein the first opening and the second opening are sized for grasping of the carrying handle by a users fingers,

3. The sheet of claim 1 further comprising opposing first side flaps attached to the top wall and opposing second side flaps attached to the bottom wall, the side walls each including an outer panel, an inner panel foldably attached to the outer panel, and an anchor panel foldably attach to the inner panel, for overlaying the first opposing side flaps and the second opposing side flaps, fowling a rigid side Wall assembly.

4. The sheet of claim 3 wherein the rear panel further comprises opposing third flaps for engaging the fixed side wall assembly and enclosing the box.

5. The sheet of claim 1 wherein the sheet is a unitary blank, printed on only one side.

6. A method of forming and using a hanging display box for an item, comprising the steps of:

providing a cardboard material;

printing the cardboard material only on one side;

stamping the cardboard material into a foldable sheet having a display panel;

removing a portion of the display panel to form a window;

placing a substantially transparent material over the window and extending substantially beyond the display panel;

folding the blank to encapsulate the transparent material and form a shell;

placing the item in the shell; and folding a rear panel over the item to form the display box.

7. The method of claim 6 further comprising the step of aligning holes in the blank to form a carrying handle.

8. The method of claim 6 further comprising the step of adhering the rear panel to the shell to seal the display box.

9. The method of claim 6 further comprising the steps of opening the box and removing the item, unfolding the blank and separating the substantially transparent material from the cardboard material.

* * * * *